US006790163B1

(12) United States Patent
Van De Laarschot et al.

(10) Patent No.: US 6,790,163 B1
(45) Date of Patent: Sep. 14, 2004

(54) SWIM STROKE EXERCISE DEVICE

(75) Inventors: Keith Van De Laarschot, W311 N4982 Old Steeple Ct., Hartland, WI (US) 53029; Mark D. Schaefer, Waukesha, WI (US)

(73) Assignee: Keith Van De Laarschot, Hartland, WI (US)

( * ) Notice: Subject to any disclaimer, the term of this patent is extended or adjusted under 35 U.S.C. 154(b) by 570 days.

(21) Appl. No.: 09/636,473

(22) Filed: Aug. 10, 2000

(51) Int. Cl.[7] ..... A63B 21/008
(52) U.S. Cl. ..... 482/56; 434/254
(58) Field of Search ..... 482/51–53, 57, 482/70, 71, 55–56, 111, 95–96, 114–120; 434/254

(56) References Cited

U.S. PATENT DOCUMENTS

| | | | | |
|---|---|---|---|---|
| 3,124,815 A | | 3/1964 | Harvey | 9/311 |
| 4,479,647 A | | 10/1984 | Smith | 272/117 |
| 4,537,396 A | | 8/1985 | Hooper | 272/130 |
| 4,577,859 A | | 3/1986 | Gossett | 272/71 |
| 4,830,363 A | | 5/1989 | Kennedy | 272/71 |
| 4,844,450 A | | 7/1989 | Rodgers, Jr. | 272/71 |
| 4,978,119 A | | 12/1990 | Hull | 272/71 |
| 5,029,848 A | | 7/1991 | Sleamaker | 272/71 |
| 5,158,513 A | | 10/1992 | Reeves | 482/56 |
| 5,324,251 A | | 6/1994 | Watson | 602/16 |
| 5,354,251 A | | 10/1994 | Sleamaker | 482/96 |
| 5,366,426 A | | 11/1994 | Glavin | 482/56 |
| 5,429,564 A | | 7/1995 | Doane | 482/56 |
| 5,435,798 A | * | 7/1995 | Habing et al. | 482/5 |
| 5,540,591 A | | 7/1996 | Doane | 434/254 |
| 5,707,320 A | | 1/1998 | Yu | 482/56 |
| 5,762,584 A | * | 6/1998 | Daniels | 482/5 |

* cited by examiner

*Primary Examiner*—Stephen R. Crow
(74) *Attorney, Agent, or Firm*—Boyle, Fredrickson, Newholm, Stein & Gratz, S.C.

(57) ABSTRACT

A swim stroke exercise device including an adjustable resistance mechanism is provided. The resistance mechanism is attached to one end of the exercise device and includes a roller assembly having a roller clutch and a drive shaft extending from one end and a spring rewind assembly attached opposite the drive shaft. The drive shaft supports a drive pulley including a number of concentric engagement areas having different diameters. Adjustably disposed above the roller assembly, a resistance device includes an output shaft terminating in a mag pulley opposite the resistance device formed similarly to the drive pulley with a number of concentric engagement areas having different diameters that are aligned with the engagement areas on the drive pulley. The concentric engagement areas allow a belt trained about the pulleys to be moved to various positions on both the drive pulley and mag pulley to increase or decrease the amount of resistance provided to the drive shaft by the clutch. A separate adjustment mechanism is also connected directly to the clutch to vary the resistance provided by the clutch. An elongate member is attached to the roller assembly and is pulled to simulate a swimming motion against the resistance provided by the resistance device and the spring rewind assembly. When pulling ceases on the elongate member, the spring rewind assembly retracts the elongate member without interference from the resistance mechanism due to the roller clutch.

16 Claims, 3 Drawing Sheets

FIG. 2
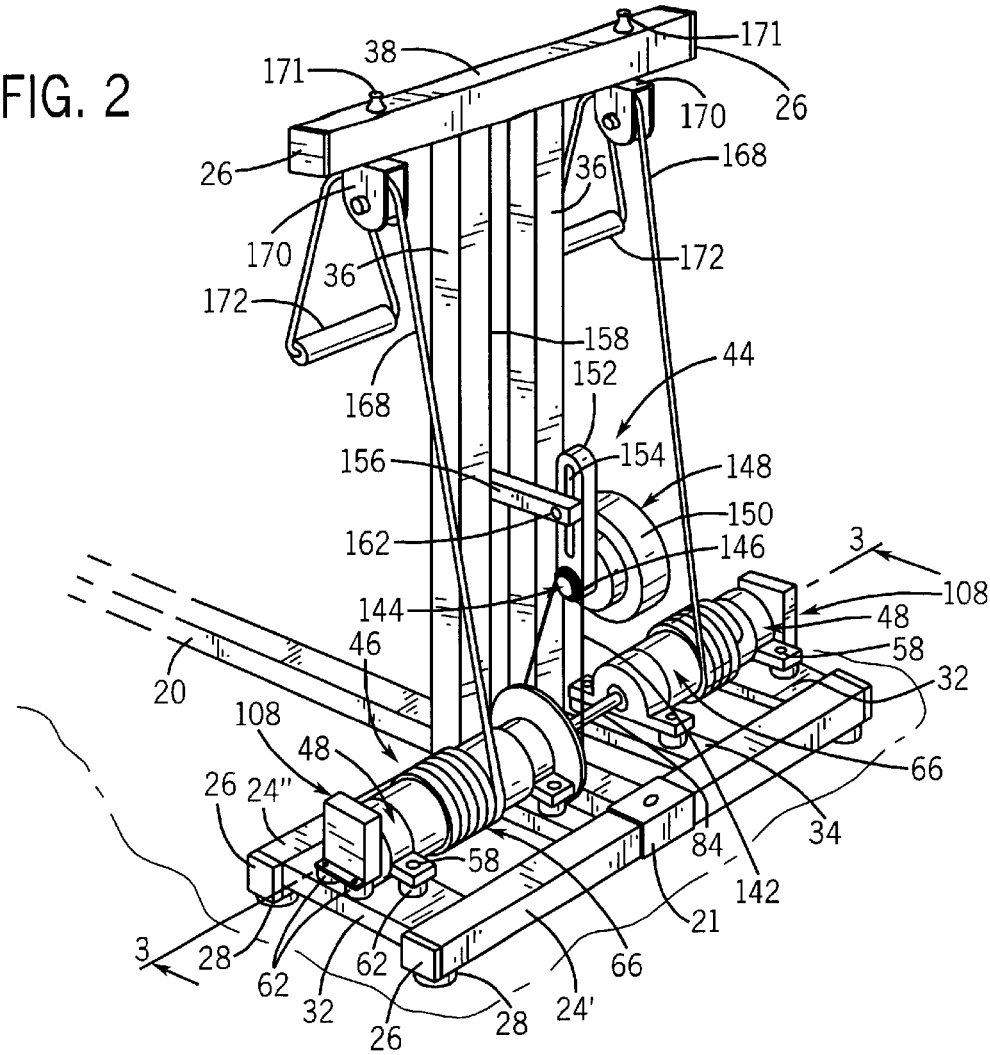
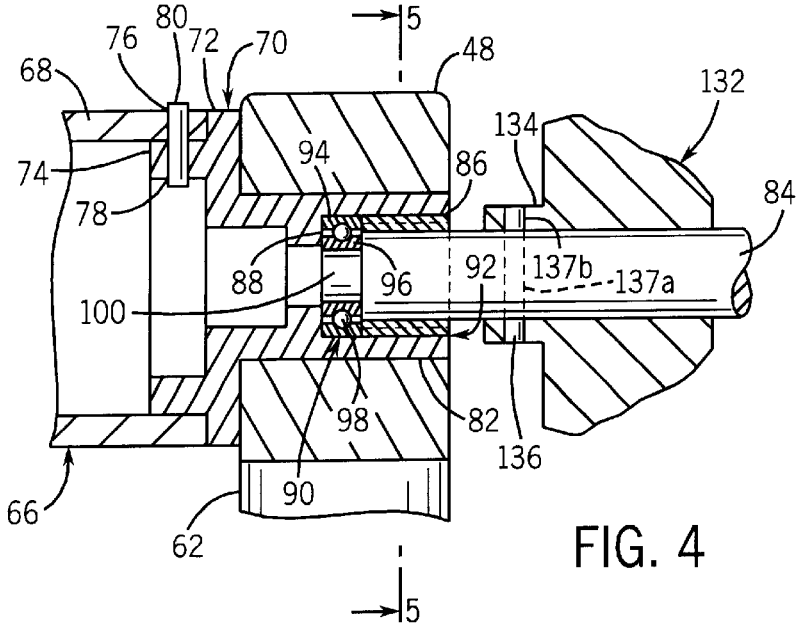
FIG. 4

SWIM STROKE EXERCISE DEVICE

FIELD OF THE INVENTION

The present invention relates to exercise machines, and more specifically to a swim stroke exercise device.

BACKGROUND OF THE INVENTION

In order for people to more conveniently maintain regular exercise programs, a large number of in-home exercise devices have been developed to enable these people to exercise in their homes. These machines have been developed to simulate a wide variety of methods of exercise, including running, rowing, cross-country skiing and weight lifting.

A number of exercise devices have also been developed to allow an individual to exercise by simulating a swimming motion or stroke. These devices generally include a bench mounted to a support frame on which the individual may place his body while performing the exercise. Opposite the bench, the exercise device has a resistance mechanism including a pair of hand grips. The individual utilizing the device grasps the hand grips and pulls on them in a simulated swimming stroke motion against the resistance provided by the resistance mechanism. These devices may also include attachments which enable a person to exercise his legs in conjunction with the motion of his arms against the resistance mechanism. Some examples of exercise devices that simulate swimming motions are disclosed in Reeves U.S. Pat. No. 5,158,513, Rodgers, Jr. U.S. Pat. No. 4,844,450, Glavin U.S. Pat. No. 5,366,426, Kennedy U.S. Pat. No. 4,830,363 and Doane U.S. Pat. No. 5,540,591.

Some other types of exercise machines that have been developed utilize a number of different types of resistance mechanisms to simulate more than one type of exercise. One such machine is disclosed in Sleamaker U.S. Pat. No. 5,354,251. The resistance provided by the machine during the exercise motion comes from a resistance mechanism disposed at the front of the machine. The resistance mechanism can take a variety of forms, including a magnetic (eddy current) resistance unit that creates variable input-responsive resistance during the exercise. With this unit, a conductive disk turns in response to a rotatable shaft on the front post of the machine which is rotated by the motion of the exercising individual. A stationary disk supporting spaced magnets creates magnetic flux lines that are cut by the rotation of the conductive disk to create a torque resistance proportional to the number of flux lines, the radius and the speed of rotation of the conductive disk and inversely proportional to the resistance of the conductive disk. The resistance provided by the unit is transferred to the individual performing a swimming motion on the machine through a pair of pull cables connected to the resistance mechanism. When the individual performs an exercise motion and pulls on the cables, the resistance unit provides resistance against the extension of the cables by the individual to exercise the individual's muscles.

While exercise machines such as those illustrated in the above-mentioned patents allow individuals to exercise in almost any location by performing a simulated swimming motion, these machines do not allow an individual to vary the amount of resistance provided by the machine. Thus, in order to obtain a more vigorous workout using the machine, the individual only has the options of either increasing the amount of time spent exercising, or increasing the number of repetitions of the exercise motion performed on the machine to vary the intensity of the workout.

Furthermore, each of the above exercise machines provides a continuous level of resistance throughout the entire swim stroke motion. This resistance can cause significant problems during the return or recovery portion of the swim stroke because no major muscles can act against the resistance provided by the machine. As a result, the machine can seriously injure an individual using the machine during the recovery portion of the swim stroke.

Therefore, it is desirable to develop a swim stroke exercise machine including a resistance mechanism that enables an individual to easily adjust the resistance provided by the mechanism. It is also desirable that the mechanism be adjustable in a variety of ways in order to provide the individual using the exercise machine with a large number of resistance options when exercising on the machine. It is still also desirable to develop an exercise machine in which the resistance provided during the recovery portion of the exercise motion is greatly reduced or eliminated to prevent injury to the individual using the machine.

SUMMARY OF THE INVENTION

It is an object of the present invention to provide an exercise machine that simulates a swimming stroke and includes an adjustable resistance mechanism that enables an individual to select one of multiple resistance levels when exercising on the machine.

It is a further object of the invention to provide an exercise machine that enables additional resistance levels to be added to the machine by the configuration of various components of the resistance mechanism.

It is still a further object of the invention to provide an exercise machine that allows for quick and easy adjustment of the resistance level provided by the resistance mechanism on the machine.

It is still another object of the invention to provide an exercise machine that does not provide any resistance during the recovery portion of the exercise motion to avoid causing injury to the individual using the machine.

The exercise machine of the present invention enables an individual to exercise by simulating a swimming motion. The machine includes a longitudinal base having a rear frame assembly attached to one end. The rear frame assembly includes a support structure having a pair of braces extending upwardly from the base and a cushioned support board positioned on the braces opposite the base on which an individual places his or her body when utilizing the machine.

The base also includes a front frame assembly opposite the rear frame assembly. The front frame assembly extends from the base generally parallel to the rear frame assembly and has a bottom end attached to the base and a top end opposite the bottom end, on which is secured a crossbeam.

A resistance mechanism is attached to the front frame assembly of the machine to provide resistance to an individual exercising on the machine. The resistance mechanism includes at least one roller assembly rotatably secured to the bottom end of the front frame assembly. The roller assembly includes a drive shaft extending from one end on which is disposed a drive pulley. The shaft is connected to the roller assembly by a one-way roller clutch that enables the roller assembly to rotate independently of the drive shaft in one direction, and in concert with the shaft in the opposite direction. A resistance device is disposed on the front frame assembly above the roller assembly and includes a mag pulley connected to the resistance device by an output shaft. The mag pulley is disposed directly above the drive pulley, and a resilient belt-like member is trained about the mag pulley and the drive pulley in order to transfer the resistance provided by the resistance device through the mag pulley to the drive pulley, drive shaft and roller assembly. Both the drive pulley and the mag pulley may have a staggered or stepped configuration. This configuration of each pulley allows the belt-like member to be positioned at different locations on each pulley to increase or decrease the resistance provided by the resistance device to the roller assembly.

In order to transfer the resistance provided by the resistance device on the roller assembly to the individual performing the exercise, an elongate member is attached at one end to the roller assembly. The elongate member winds about the roller assembly and extends upwardly from the roller assembly, and passes through a rotatable member secured to the crossbeam at the top end of the front frame assembly. Opposite the roller assembly, the elongate member terminates in a handle that is grasped by the individual when performing an exercise motion on the machine.

When an individual simulates a swimming motion on the machine, the individual pulls on the elongate member such that the elongate member unwinds from its position around the roller assembly. The rotation of the roller assembly rotates the drive shaft, the drive pulley, the mag pulley and the output shaft against the resistance provided by the resistance device.

Also, as the individual pulls on the elongate member, unwinding the member from the roller assembly by rotating the roller assembly, the rotation of the roller assembly winds a spring assembly disposed at one end of the roller assembly. When an individual has completed a simulated swim stroke, the spring mechanism acts to rotate the roller assembly in the opposite direction to rewind the elongate member about the roller assembly, preparing the roller assembly to provide resistance upon initiation by the individual of the next simulated swim stroke motion. The roller clutch disengages the drive shaft from the roller assembly while the elongate member is rewound on the roller assembly, preventing the drive shaft from rotating with the roller assembly and providing resistance from the resistance device against the bias of the spring assembly.

Various other features, objects and advantages of the invention will be made apparent from the following detailed description taken together with the drawings.

BRIEF DESCRIPTION OF THE DRAWINGS

The drawings illustrate the best mode presently contemplated of carrying out the invention.

In the drawings:

FIG. 2 is a partial isometric view of the front frame assembly and resistance mechanism of the machine shown in FIG. 1;

FIG. 4 is a circular cross-sectional view along line 4—4 of FIG. 3;

DETAILED DESCRIPTION OF THE INVENTION

Figure 1:
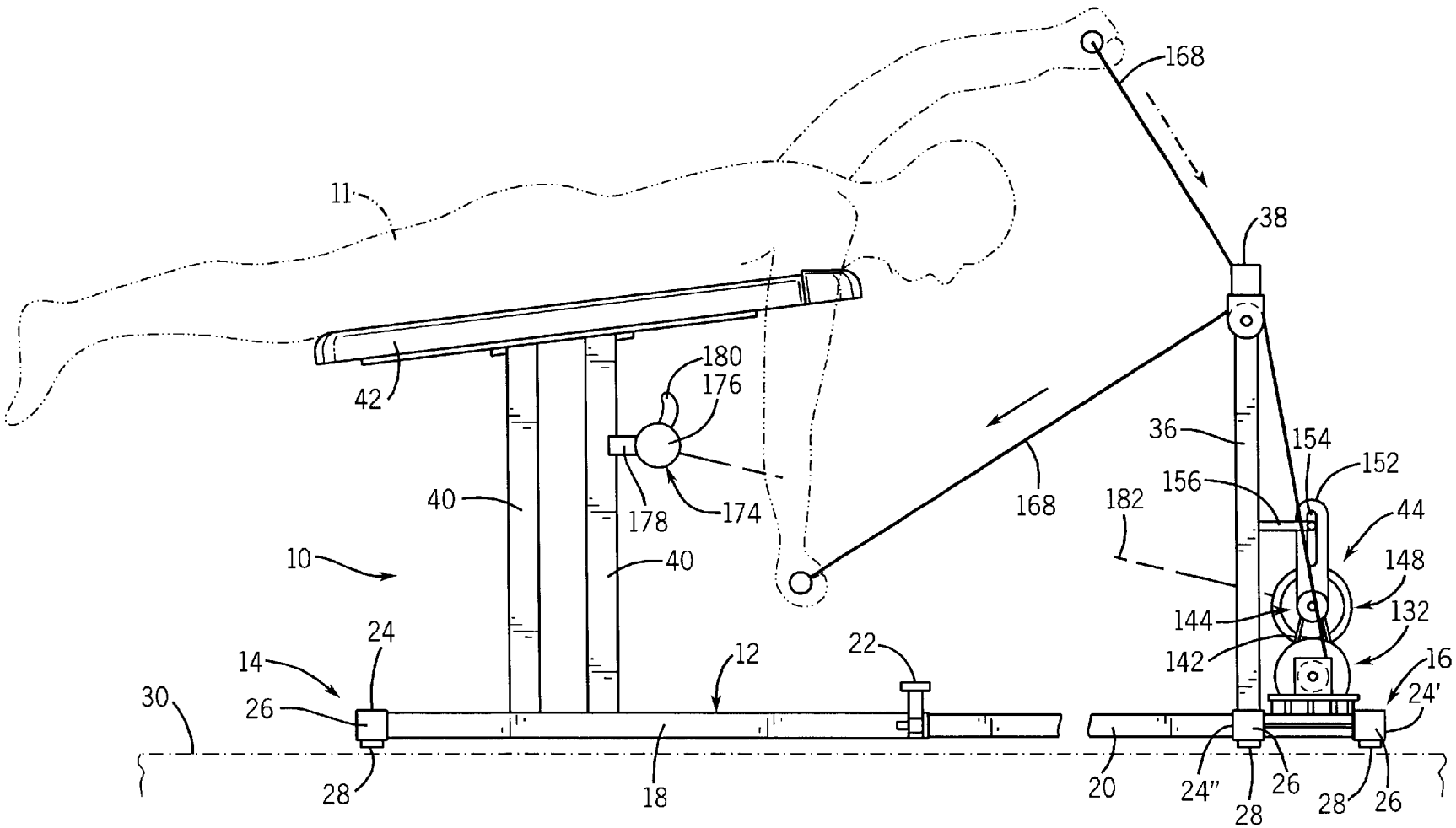
FIG. 1 is an isometric view of an individual simulating a swimming motion on the exercise device of the present invention.

Wherein like reference numerals designate like parts throughout the disclosure, a swim stroke exercise device indicated in general at 10 is illustrated in FIG. 1. The device 10 includes an adjustable, longitudinal base 12 having a rear end 14 and a front end 16. The base 12 includes a generally square tubular housing 18 that extends from the rear end 14 towards the front end 16. The base 12 also includes a tube 20 slidably matable within the housing 18 that extends from the housing 18 to the front end 16 of the base 12. The tube 20 can be secured to the housing 18 by pin 22 attached to the exterior of the housing 18. The pin 22 engages the tube 20 within the housing 18 to releasably position the tube 20 at a desired position relative to housing 18.

The rear end 14 of the base 12 includes a first stabilizing leg 24 perpendicularly secured to housing 18 opposite tube 20 to assist in maintaining the device 10 in the upright position of FIG. 1. The leg 24 is also formed from a hollow, square tube having a generally square end cap 26 secured within each end of the leg 24 and a pair of rubber feet 28 disposed on the underside of leg 24 adjacent each end to resiliently support the leg 24 over a floor 30 on which the device 10 rests.

Looking now at FIGS. 1 and 2, the front end 16 also includes a second stabilizing leg 24' secured to the tube 20 by a bracket 21 opposite the housing 18. The second leg 24' is formed similarly to the first leg 24 and includes identical end caps 26 and rubber feet 28. The front end 16 also includes a third stabilizing leg 24" positioned inwardly along the tube 20 from the second leg 24'. The third leg 24" is formed similarly to legs 24,24', including identical end caps 26 and feet 28. Leg 24' and leg 24" are connected to one another apart from the tube 20 by a pair of support plates 32 extending between the adjacent ends of each leg 24',24". Leg 24' and leg 24" are also connected by a pair of support bars 34 extending between the second and third legs 24',24" and disposed on either side of the tube 20.

Figures 3, 5, 6:
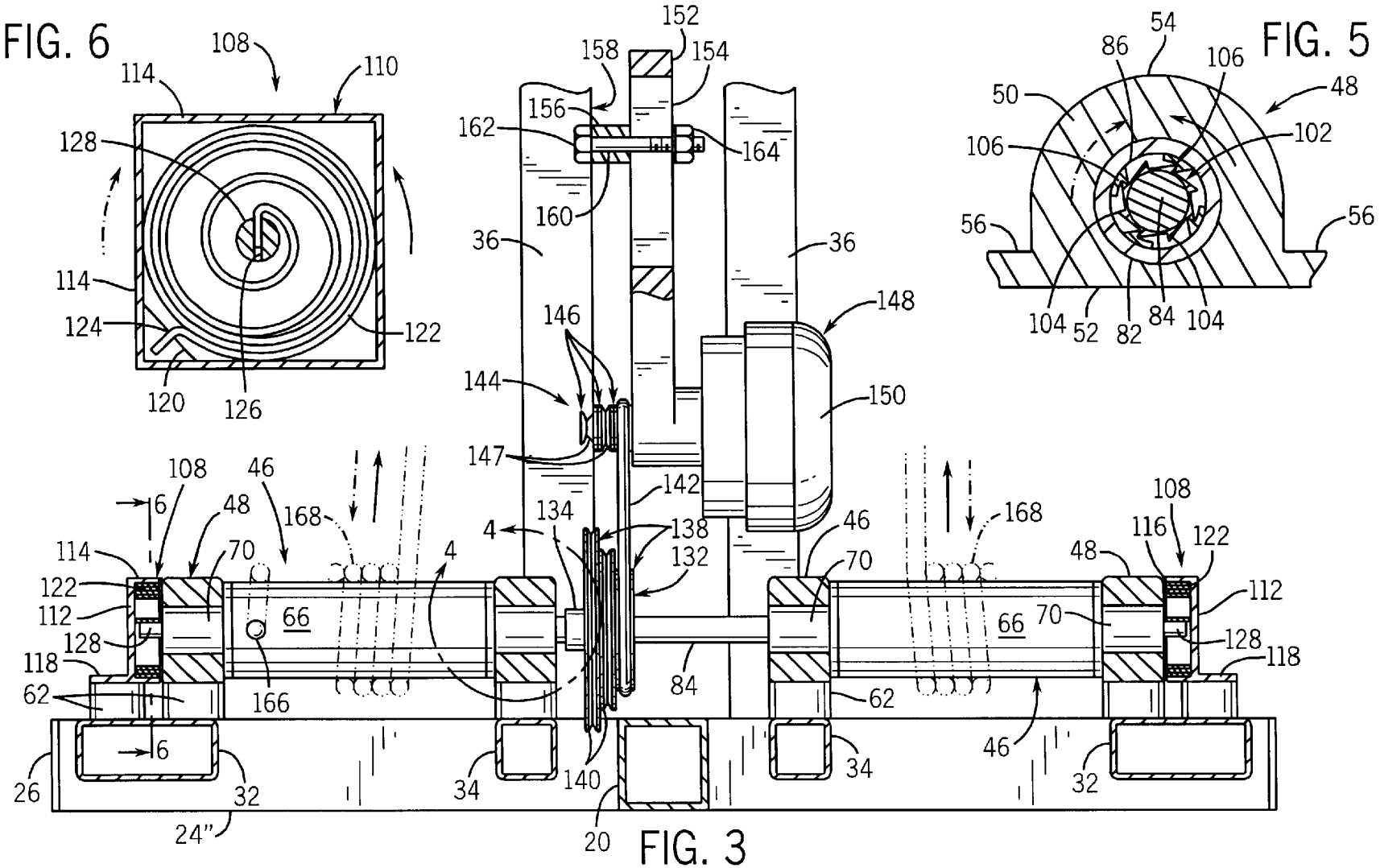
FIG. 3 is a cross-sectional view along line 3—3 of FIG. 2.
FIG. 5 is a cross-sectional view along line 5—5 of FIG. 4.
FIG. 6 is a cross-sectional view along line 6—6 of FIG. 3.

Referring now to FIGS. 2 and 3, a pair of vertical support members 36 are attached to the third leg 24" on opposite sides of the tube 20. The members 36 extend upwardly from the third leg 24" and are secured opposite the leg 24" to a horizontal crossbeam 38. The crossbeam 38 includes end caps 26 at each end and extends perpendicularly to the vertical members 36 and parallel to the third leg 24".

Looking again at FIG. 1, to enable a person 11 to use the device 10, adjacent the rear end 14 of the base 12 is located a pair of braces 40 of differing lengths that are attached to and extend upwardly generally perpendicular to the housing 18. The braces 40 are spaced from one another along the housing 18 and are connected opposite the housing to a board 42 which angles upwardly from the rear end 14 of the base 12 towards the front end 16 due to the differences in height of the braces 40. The board 42 serves to support the person 11 when exercising on the device 10.

Referring now to FIGS. 2–5, a resistance mechanism 44 is disposed on the base 12 at the front end 16 of the device 10. The mechanism 44 includes a pair of roller assemblies 46 located in alignment with one another on either side of the tube 20. Each roller assembly 46 includes a pair of pillow blocks 48 disposed at each end. Each block 48 includes a center portion 50 having a flat side 52 and an arcuate side 54. A pair of flanges 56 extend outwardly from opposite ends of the flat side 52 and include bores 58 adapted to receive bolts or screws (not shown) that secure the pillow blocks 48 to the base 12. The pillow blocks 48 for each roller assembly 46 are spaced from one another and secured to the respective support plates 32 and support bars 34 disposed on opposite sides of the tube 20. A rubber spacer 62 is disposed between each flange 56 and the respective support plate 32 or support bar 34. Each spacer 62 includes a central opening (not shown) that allows the screw to pass through the spacer 62 and engage the support plate 32 or support bar 34. In this manner the pillow block 48 is securely mounted to the base 12 such that each roller assembly 46 may move slightly to better absorb the stress exerted on the assembly 46 when the device 10 is in use.

The center portion 50 of each pillow block 48 also includes a circular channel 64 extending through the center portion 50. The channels 64 in each pair of pillow blocks 48 rotatably receive opposite ends of a roller 66 extending between the pairs of blocks 48. Each roller 66 is formed of a hollow cylinder 68 having a pair of bearings 70 secured to either end. As best shown in FIG. 4, each bearing 70 includes a central circular section 72 having a diameter approximately equal to that of the cylinder 68. The bearing 70 also includes a reduced diameter section 74 extending from one side of section 72 that corresponds in diameter to the inner diameter of the cylinder 68. Section 74 includes an opening 76 that is alignable with one of a pair of similar diameter openings 78 disposed adjacent each end of the cylinder 68. The respective aligned openings 76, 78 receive a pin 80 in order to secure the bearing 70 within the end of the cylinder 68.

Opposite the reduced diameter section 74, each bearing 70 also includes a cylindrical boss 82 extending from the central section 72. Boss 82 is inserted within the channel 64 in pillow block 48 and extends from central section 72 a length equal to the length of the channel 64. The boss 82 also has a diameter slightly less than that of channel 64 such that when a roller 66 is secured between a pair of pillow blocks 48, the bearings 70 and bosses 82 not only support the roller 66 between the pillow blocks 48 but allow the roller 66 to rotate freely with respect to the pillow blocks 48.

Referring now to FIGS. 3–5, the roller assemblies 46 are connected by a drive shaft 84 extending between the pillow blocks 48 of each roller assembly 46 positioned adjacent each side of tube 20. As best shown in FIG. 4, each end of the shaft 84 is inserted into a cylindrical recess 86 defined within the boss 82 of each bearing 70. Each recess 86 has an inner end defined by a radial annular shoulder 88 extending inwardly from the inner surface of boss 82. Each recess 86 also encloses a conventional ball bearing assembly 90 disposed against the shoulder 88, and a roller clutch assembly 92 abutting the ball bearing assembly 90 and flush with the end of the boss 82.

The ball bearing assembly 90 includes an outer race 94 disposed against the inner surface of boss 82 and an inner race 96 spaced from outer race 94 by a number of freely rotating ball bearings 98. The outer race 94 is frictionally engaged with the inner surface of boss 82, and the inner race 96 is frictionally engaged with a stub shaft 100 extending from the end of drive shaft 84, such that the outer race 94 and boss 82 can rotate with respect to the inner race 96 and stub shaft 100.

The roller clutch assembly 92 is disposed immediately adjacent the ball bearing assembly 90 and includes a sprocket 102 (FIG. 5) disposed about the end of the drive shaft 84. The sprocket 102 includes a plurality of radially extending teeth 104 that can engage a number of stops 106 fixedly secured about the circumference of the inner surface of the boss 82. As best shown in FIG. 5, the shape of the teeth 104 allows the stops 106 and boss 82 to rotate separately from shaft 84 past the teeth 104 on sprocket 102 in the clockwise direction, but prevents the stops 106 from rotating independently of the shaft 84 in the opposite, counterclockwise direction.

Referring now to FIGS. 2, 3 and 6, to return an elongate member 168 and handles 172, attached to the rollers 66 in a manner to be described later, to an at rest position, a spring assembly 108 is engaged with each roller 66 opposite the drive shaft 84. Each spring assembly 108 includes a generally square housing 110 having an end wall 112, a number of side walls 114 extending from end wall 12, a cover plate 116 secured to the side walls 114 opposite end wall 112, and a securing flange 118 extending from end wall 112 opposite cover plate 116. Each housing 110 is secured to the support plate 32 adjacent the outer pillow block 48 of each assembly 46 by a pair of bolts (not shown) inserted through openings (not shown) in flange 118 and rubber spacers 62 to releasably engage the support plate 32.

The interior of the housing 110 defined by the side walls 114 includes an angular wall 120 extending across one corner of the housing. One end of a torsion spring 122 is inserted through an opening 124 in the angular wall 120 that provides an anchor for the spring 122. The opposite end of spring 122 is inserted into a slot 126 located in a rod 128 having one end extending through an opening 130 in cover plate 116 into the interior of the housing 110. The opposite end of the rod 128 is fixedly secured within the cylindrical recess 86 of the adjacent bearing 70 such that the rod 128 rotates with the roller 66. Thus, when the roller 66 rotates in the counterclockwise direction, the torsion spring 122 is wound through its engagement with the rod 128. When the roller 66 ceases to rotate in the counterclockwise direction, the torsional biasing force of wound spring 122 unwinds and serves to rotate the roller 66 in the clockwise direction until the spring 122 reaches its original unwound position and the handles 172 are returned to the starting position.

Looking now at FIGS. 2–4, a drive pulley 132 is disposed on drive shaft 84 adjacent one of the roller assemblies 46. The drive pulley 132 includes a collar 134 extending inwardly around drive shaft 84 toward the adjacent pillow block 48. The pulley 132 and collar 134 are secured to the drive shaft 84 by a pin 136 inserted through aligned openings 137*a*,137*b* in the shaft 84 and collar 134, respectively. Opposite the collar 134, the drive pulley 132 includes a number of concentric circular engagement areas 138 located outwardly from the shaft 84, which define a stepped configuration. The diameter of each engagement area 138 is successively smaller in a direction from the collar 134 to the opposite end of the pulley 132. Furthermore, each engagement area 138 includes a V-shaped groove 140 that extends about the circumference of the engagement area 138. The grooves 140 receive and retain a belt 142 that extends from one of the engagement areas 138 on pulley 132 to connect the pulley 132 with the resistance mechanism 44.

The resistance mechanism 44 includes a mag pulley 144 disposed directly above drive pulley 132. Mag pulley 144 is formed similarly to drive pulley 132 to define a stepped configuration, including a number of concentric circular engagement areas 146 including V-shaped grooves 147 that are aligned with the engagement areas 138 on drive pulley 132. The engagement areas 146 on mag pulley 144 decrease in diameter oppositely to the engagement areas 138 on drive pulley 132, so that the smallest diameter engagement area 146 on mag pulley 144 is aligned with the largest diameter engagement area 138 on drive pulley 132.

The mag pulley 144 is connected to a rotatable output shaft (not shown) that extends into a housing 148 for resistance mechanism 44. The housing 148 encloses a magnetic particle clutch 150 that is connected to the output shaft opposite the mag pulley 144 and provides the resistance for the device 10. Magnetic particle clutch 150 is of conventional construction and operation, and illustratively may be a clutch as manufactured by Performance of Chapel Hill, N.C. under its part number SD 200, although it is understood that other satisfactory magnetic resistance devices may be employed.

Above the magnetic particle clutch 150, an upwardly extending arm 152 extends from housing 148, and is used to secure the housing 148 to a post 156 that extends over the housing 148 from an interior edge 158 of one of the vertical support beams 56. The arm 152 has a longitudinal slot 154 along its center line that is releasably attachable to a bore 160 in the post 156 alignable with the slot 154 in arm 152. A bolt 162 is inserted through the bore 160 in post 156 and slot 154 in arm 152 to engage a nut 164 and releasably retain the housing 148 on the post 156.

To enable the resistance supplied by the resistance mechanism 44 to act against the motions of an individual 11 exercising on the device 10, as best shown in FIGS. 1–3, the cylinder 68 of each roller 66 further includes an opening 166 extending into the interior of the cylinder 68 and located adjacent the bearing 70 connected to the spring assembly 108. A flexible elongate member 168 such as a rope is secured to the interior of the cylinder 68 by threading one end of the member 168 through the opening 166 and knotting that end of the member 168 within the interior of the cylinder 68. The elongate member 168 is then wound around the cylinder 68 of roller 66 to provide a sufficient length to the elongate member 168 to enable the individual 11 to perform a number of different exercise motions on the device 10. From the roller 66, the elongate member 168 then extends upwardly through a pulley assembly 170 pivotably secured to the underside of the crossbeam 38. The end of the elongate member 168 opposite the roller 66 terminates in a handle 172 that is grasped by the individual 11 when performing an exercise on the device 10.

To use the device 10, individual 11 rests on the board 42 in the position shown in FIG. 1. The individual then grasps the handles 172 on each elongate member 168 and proceeds to move his or her arms in a motion simulating a swimming stroke. When the individual pulls on one of the handles 172, the attached elongate member 168 unwinds from the roller 66 against the bias of the magnetic particle clutch 150 which acts on the roller 66 through the mag pulley 144, belt 142 and drive pulley 132, and against the bias of the torsion spring 122.

More specifically, when the individual 11 pulls on the elongate member 168, the elongate member 168 rotates the roller 66 to which member 168 is attached in a direction towards the individual 11. By rotating in this direction, the roller 66 rotates the bearing 70 and stops 106 in the same direction as the roller. When rotating in this direction, the stops 106 engage the teeth 104 located on the sprocket 102. Because the sprocket 102 is connected to the drive shaft 84, the engagement of the stops 106 with the teeth 104 causes the shaft 84 to rotate in the same direction as the roller 66. Consequently, the rotation of the shaft 84 rotates the drive pulley 132 that, via the belt 142, rotates the mag pulley 144. The rotation of the mag pulley 144 is opposed by the magnetic particle clutch 150 and that resistance is transferred through the mag pulley 144 to the drive pulley 132, through the drive pulley to the shaft 84, from the shaft 84 to the roller 66, and from the roller 66 to the elongate member 168 to provide resistance when the elongate member 168 is pulled by the individual.

As the roller 66 is rotated by the pulling of the elongate member 168 against the resistance provided by the magnetic particle clutch 150, the rotation of the roller 66 is also opposed by operation of the spring assembly 108. As the roller 66 rotates towards the individual 11, the torsion spring 122 in the spring assembly 108 attached to the roller 66 is tensioned by the rotation of the roller 66.

When the individual 11 has completed the rearward swimming motion, releasing the tension on the elongate member 168, the bias of the wound torsion spring 122 acts on the roller 66 to rotate the roller 66 in the opposite direction away from the individual 11 and rewind the elongate member 168 about the roller 66. Furthermore, while the spring 122 rewinds the elongate member 168, the magnetic particle clutch 150 does not provide any resistance against the rotation of the roller 66. This is due to the operation of the bearing assembly 90 and the roller clutch 92. More specifically, when the roller 66 rotates in a direction away from the individual 11, the stops 106 on the bearing 70 do not engage the teeth 104 on the sprocket 102, preventing the shaft 84 from rotating in conjunction with the roller 66. The roller 66 freely rotates with the outer race 94 of the bearing assembly 90 while the shaft 84 and inner race 96 remain relatively stationary. Therefore, no resistance is transmitted to the roller 66 from the magnetic particle clutch 150 through the shaft 84 while the elongate member 168 is rewound about the roller 66. Furthermore, because no resistive force is acting on the elongate member 168 when the member is rewound on the roller 66, no stress is placed on the shoulder of the individual 11 when the shoulder is in a vulnerable upraised position. Once the elongate member 168 is rewound around the roller 66 to the desired length, the individual 11 may then pull again on the handle 172 and elongate member 168 to again engage the roller 66 with the drive shaft 84 and particle clutch 150 of resistance mechanism 44.

When the individual 11 performs a swimming motion on the device 10 in which both elongate members 168 are pulled simultaneously, the magnetic particle clutch 150 provides equal resistance through the shaft 84 to each of the rollers 66. Further, as the individual 11 releases the tension on each member 168, the particle clutch 150 is prevented from applying resistance to either roller 66 by the operation of the roller clutches 92, described above, allowing the spring assemblies 108 to rewind the elongate members 168 on the respective rollers 66.

However, when the individual 11 performs a swimming motion that involves the alternating movement of the elongate members 168, resistance from the particle clutch 150 is applied and removed from each roller 66 in an alternating fashion between the respective roller 66. Due to the presence of a roller clutch 92 in each roller assembly 46, the device 10 enables the magnetic particle clutch 150 to provide resistance to one of the rollers 66 while the associated elongate member 168 is pulled by the individual while preventing the particle clutch 150 from resisting the rotation of the second roller 66 as the elongate member 168 associated with the second roller 66 is rewound by the operation of the associated spring assembly 108.

The device 10 also allows an individual to vary the amount of resistance provided by the resistance mechanism 44. One method in which the individual can vary the resistance is by changing the position of the belt 142 on the mag pulley 144 and drive pulley 132 by placing the belt on a different aligned pair of engagement areas 138,146. By changing the pair of engagement areas 138,146 around which the belt 142 is trained, the individual can selectively increase or decrease the resistance provided by the mechanism 44.

To change the position of the belt 142, the individual 11 loosens the nut 164 on the bolt 160 holding the arm 152 of the housing 148 to the post 156 at a specified point along the slot 154 in the arm 152. The housing 148 may then be lowered towards the roller assemblies 46 such that the belt 142 is no longer tensioned and can be disengaged from the respective engagement areas 138, 146 on the drive pulley 132 and mag pulley 144. Once the belt 142 has been repositioned on the desired engagement areas 138, 146 on the drive pulley 132 and mag pulley 144, respectively, the housing 148 may then be slid upwardly along the slot 154 to properly tension the belt 142 between the drive pulley 132 and mag pulley 144. Once the belt 142 is properly tensioned, the nut 164 can be retightened on the bolt 160 to maintain the housing 148 in that location.

Another way in which the amount of resistance provided by the mechanism 44 may be adjusted is through the use of a manual resistance adjustment mechanism 174 on the device 10. The adjustment mechanism 174 includes a housing 176 secured to a post 178 extending from the forwardmost brace 40. A lever 180 extends outwardly from the housing 176 and allows the individual 11 to adjust the tension in a cable 182 extending from the adjustment mechanism 174 to the magnetic particle clutch 150. The amount of tension in the cable 182 controls the amount of resistance provided by the magnetic particle clutch 150 in a manner well known in the art, and enables an individual still further options to increase or decrease the resistance provided by the clutch 150.

Apart from the preferred embodiment described previously, the structure of the device 10 can be altered to accommodate other embodiments of certain components of the device 10. For example, in lieu of the roller assemblies 46, the device 10 may include rack and pinion assemblies or reels to which the elongate members 168 are attached that, when rotated, engage and rotate the shaft 84 to transfer resistance from the magnetic particle clutch 150 to the elongate members 168. Further, the torsion springs 122 and spring assemblies 108 can be replaced by elastic torsion bars extending through the roller 66 and attached to the roller at one end and fixedly attached to a stationery support at the opposite end. The device 10 may also comprise two separate resistance mechanisms, one attached to each of the roller assemblies to provide independent resistance thereto. Further, the type of resistance mechanism used can also vary from a magnetic particle clutch to a fluid resistance mechanism, or electrically biased resistance mechanism.

Various alternatives and embodiments are contemplated as being within the scope of the following claims, particularly pointing out and distinctly claiming the subject matter regarded as the invention.

We claim:

1. An exercise machine for simulating a swimming motion comprising:

a support frame having a rear end including a body support and a front end;

a resistance mechanism located on the front end of the support frame, the mechanism including at least one roller assembly secured to the front end of the support frame, a first pulley disposed on a drive shaft extending from the roller assembly, a resistance device attached to the front end of the support frame and spaced from the first pulley, a second pulley attached to an output shaft extending from the resistance device, and a drive member operably connecting the first and second pulleys;

wherein the roller assembly comprises a sprong assembly disposed on the drive shaft and connected to the roller assembly, wherein the spring assembly includes a spring operably attached to the roller assembly to provide a rewind biasing function for the roller assembly; and at least one elongate member attached to the roller assembly at one end and having a handle disposed at the opposite end, the elongate member extending from the roller assembly through a rotatable member secured to the front end of the support frame and spaced above the resistance device, towards the rear end of the support frame.

2. The exercise machine of claim 1 wherein the drive shaft and roller assembly are connected by a roller clutch disposed around the drive shaft within the roller assembly, the roller clutch including a ball bearing assembly.

3. The exercise machine of claim 1 further comprising a second roller assembly connected to the front end of the support frame opposite the first roller assembly and connected thereto by the drive shaft; and a second elongate member extending from the second roller assembly through a second rotatable member secured to the front end of the support frame opposite the first rotatable member and ending in a second handle.

4. The exercise machine of claim 1 wherein the resistance device is adjustably mounted to the front end of the support frame above the roller assembly.

5. The exercise machine of claim 4 wherein the resistance device is selected from the group consisting of a fluid resistance device, an electrically biased resistance device, and a magnetic particle clutch.

6. The exercise machine of claim 1 wherein the first pulley includes a number of concentric engagement areas, each area having a different diameter.

7. The exercise machine of claim 1 wherein the second pulley is formed from a number of concentric engagement areas, each area having a different diameter.

8. The exercise machine of claim 1 wherein the resistance mechanism includes a remote adjustment mechanism operably connected to the resistance device.

9. A resistance mechanism for an exercise device having a support frame including a front end and a rear end, the mechanism comprising:

at least one roller assembly attached to one of the front end of the support frame;

a drive shaft connected to one end of the roller assembly;

a first pulley disposed on the drive shaft;

a spring rewind assembly disposed on the drive shaft and connected to the roller assembly;

a resistance device adjustably mounted to the support frame above the roller assembly, the resistance device including an output shaft and a second pulley disposed on the output shaft;

a resilient member operably connecting the first pulley and the second pulley; and a resistance adjustment mechanism spaced from and operably connected to the resistance device.

10. The resistance mechanism of claim 9 wherein the drive shaft and roller assembly are connected by a roller clutch disposed around the drive shaft within the roller assembly, the roller clutch including a ball bearing assembly.

11. The resistance mechanism of claim 9 further comprising a second roller assembly disposed on the support frame opposite the first roller assembly and connected thereto by the drive shaft.

12. The resistance mechanism of claim 9 wherein the first pulley includes a number of concentric engagement areas, each area having a different diameter.

13. The resistance mechanism of claim 9 wherein the second pulley is formed from a number of concentric engagement areas, each area having a different diameter.

14. The resistance mechanism of claim 9 wherein the resistance device is selected from the group consisting of a magnetic particle clutch, a fluid resistance mechanism, and an electrically biased resistance device.

15. An exercise device for simulating a swimming motion, comprising:

support structure including a body support arrangement for supporting the body of a user in a simulated swimming position;

a pair of flexible elongated members adapted to be pulled to an extended position by a user to simulate a swim stroke;

a shaft a biased retraction member having a spring rewind assembly mounted on the shaft and interconnected with each flexible elongated member for retracting the elongated member when the user ceases pulling on the flexible elongated member;

a one-way clutch mechanism interposed between the shaft and each retraction member, wherein each one-way clutch mechanism functions to couple its respective retraction member to the shaft when the user pulls on the flexible elongated member and to decouple its respective retraction member from the shaft upon retraction of the flexible elongated member; and a resistance mechanism interconnected with the shaft for imparting resistance to the shaft and each retraction member when the retraction member is coupled to the shaft by the one-way clutch upon pulling of the flexible elongated member by the user.

16. An exercise device for simulating a swimming motion comprising:

support structure including a body support arrangement for supporting the body of a user in a simulated swimming position;

a pair of flexible elongated members, each of which defines a first and a second end, wherein the first end of each elongated member is adapted to be grasped by the user when in the simulated swimming position; and a resistance arrangement interconnected with the support structure, comprising a pair of rollers mounted on a drive shaft, wherein each roller is engaged with the second end of one of the elongated member;

a biasing arrangement having a spring rewind assembly mounted on the drive shaft and interconnected with each roller for urging rotation of each roller in a first direction of rotation to coil each elongated member about its respective roller toward the second end of the elongated member; and a resistance device interconnected with each roller, wherein the first end of each elongated member is adapted to be pulled by the user when simulating a swim stroke to rotate its respective roller in a second direction of rotation to uncoil the elongated member from the roller, and where the resistance device imparts resistance to the roller upon rotation of the roller in the second direction of rotation to provide resistance to the user.

* * * * *

UNITED STATES PATENT AND TRADEMARK OFFICE

CERTIFICATE OF CORRECTION

PATENT NO. : 6,790,163 B1
DATED : September 14, 2004
INVENTOR(S) : Keith Van De Laarschot et al.

It is certified that error appears in the above-identified patent and that said Letters Patent is hereby corrected as shown below:

Column 10,
Line 1, delete "sprong" and substitute therefore -- spring --;

Signed and Sealed this

Eighteenth Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,790,163 B1
DATED : September 14, 2004
INVENTOR(S) : Keith Van De Laarschot et al.

It is certified that error appears in the above-identified patent and that said Letters Patent is hereby corrected as shown below:

Column 11,
Line 19, delete "a shaft a biased" and substitute therefore -- a shaft;
a biased……. --.

Signed and Sealed this

Fifth Day of April, 2005

JON W. DUDAS
*Director of the United States Patent and Trademark Office*